US011198452B2

(12) United States Patent
Falkenstein et al.

(10) Patent No.: US 11,198,452 B2
(45) Date of Patent: Dec. 14, 2021

(54) CHASSIS FOR A RAIL VEHICLE

(71) Applicant: SIEMENS AG OESTERREICH, Vienna (AT)

(72) Inventors: Marko Falkenstein, Wiesenbronn (DE); Christian Kueter, Stattegg (AT); Klaus Montesi-Heimerl, Krefeld (DE); Martin Teichmann, Graz (AT); Gerhard Weilguni, Graz (AT); Stefan Zierler, Zettling (AT); Xabier Gonzalez Larrache, Graz (AT); Radovan Seifried, Maribor (SI)

(73) Assignee: SIEMENS MOBILITY AUSTRIA GMBH, Vienna (AT)

( * ) Notice: Subject to any disclaimer, the term of this patent is extended or adjusted under 35 U.S.C. 154(b) by 634 days.

(21) Appl. No.: 16/072,639

(22) PCT Filed: Jan. 26, 2017

(86) PCT No.: PCT/EP2017/051591
§ 371 (c)(1),
(2) Date: Jul. 25, 2018

(87) PCT Pub. No.: WO2017/133954
PCT Pub. Date: Aug. 10, 2017

(65) Prior Publication Data

US 2019/0031210 A1 Jan. 31, 2019

(30) Foreign Application Priority Data

Feb. 1, 2016 (AT) ..... A50054/2016

(51) Int. Cl.
*B61C 9/48* (2006.01)
*B61C 9/50* (2006.01)
(Continued)

(52) U.S. Cl.
CPC ..... *B61C 9/48* (2013.01); *B61C 9/50* (2013.01); *B61F 1/06* (2013.01); *B61F 3/04* (2013.01); *B61F 13/00* (2013.01)

(58) Field of Classification Search
CPC ..... B61C 9/48; B61C 9/50; B61F 1/06; B61F 3/04; B61F 3/06; B61F 5/50; B61F 13/00
(Continued)

(56) References Cited

U.S. PATENT DOCUMENTS 1,602,299 A * 10/1926 Bethel ..... B61C 9/50 105/139
4,046,080 A 9/1977 Dieling et al.
(Continued)

FOREIGN PATENT DOCUMENTS

CN 101124417 2/2008
CN 201165219 Y 12/2008
(Continued)

*Primary Examiner* — Zachary L Kuhfuss
(74) *Attorney, Agent, or Firm* — Cozen O'Connor

(57) ABSTRACT

A chassis for a rail vehicle, in particular with inboard wheel sets, with at least one transmission, at least one transversely mounted drive motor and at least one chassis frame, wherein the chassis frame includes at least one crossmember and at least a first longitudinal carrier and a second longitudinal carrier, where at least a first elastic bearing, a second elastic bearing and a third elastic bearing are arranged between the drive motor and the chassis frame, and where in each case one of the elastic bearings is arranged on at least one of the longitudinal carriers in order to provide advantageous construction conditions.

23 Claims, 4 Drawing Sheets

(51) Int. Cl.
*B61F 1/06* (2006.01)
*B61F 3/04* (2006.01)
*B61F 13/00* (2006.01)

(58) Field of Classification Search
USPC ..... 105/133
See application file for complete search history.

(56) References Cited

U.S. PATENT DOCUMENTS 4,170,945 A * 10/1979 Kayserling ..... B61C 9/44 105/131
4,228,739 A * 10/1980 Fitzgibbon ..... B61C 9/50 105/136
4,279,202 A 7/1981 Dieling et al.
4,526,107 A * 7/1985 Mautner ..... B61F 3/04 105/133
4,542,699 A * 9/1985 Smith ..... B61F 5/44 105/131
6,253,686 B1 * 7/2001 Koelsch ..... B61C 9/50 105/131
7,410,209 B2 8/2008 Clapie
9,994,240 B2 * 6/2018 Haigermoser ..... B61C 17/00
2010/0300324 A1 * 12/2010 Brandstetter ..... B61F 3/04 105/96.1
2016/0001793 A1 * 1/2016 Haigermoser ..... B61C 17/00 105/79

FOREIGN PATENT DOCUMENTS

| | | | |
|---|---|---|---|
| CN | 102332769 | | 1/2012 |
| CN | 105008204 | | 10/2015 |
| CN | 105197022 | | 12/2015 |
| DE | 2826155 | | 12/1979 |
| DE | 2925836 | | 11/1980 |
| DE | 20200800747 | | 12/2008 |
| DE | 102010010786 | | 9/2011 |
| EA | 015593 | B1 | 10/2011 |
| EP | 0216082 | | 4/1987 |
| EP | 0979190 | | 2/2000 |
| RU | 111824 | U1 | 12/2011 |
| RU | 2507096 | C1 | 2/2014 |
| RU | 2558420 | C1 | 8/2015 |
| RU | 154856 | U1 | 9/2015 |
| WO | WO2008/125500 | | 10/2008 |
| WO | WO2012/123438 | | 9/2012 |
| WO | WO2014/135416 | | 9/2014 |

* cited by examiner

CHASSIS FOR A RAIL VEHICLE

CROSS-REFERENCE TO RELATED APPLICATIONS

This is a U.S. national stage of application No. PCT/EP2017/051591 filed Jan. 26, 2017. Priority is claimed on Austrian Application No. A50054/2016 filed Feb. 1, 2016, the content of which is incorporated herein by reference in its entirety.

BACKGROUND OF THE INVENTION

1. Field of the Invention

The invention relates to a chassis for a rail vehicle, in particular with inboard wheel sets, with at least one transmission, at least one transversely mounted drive motor, and with at least one chassis frame, which comprises at least one crossmember, at least one first longitudinal carrier and one second longitudinal carrier.

2. Description of the Related Art

Chassis for rail vehicles must be safe against derailment. Derailment safety can be achieved via the chassis reacting in a flexible manner to track twists. Flexibility in relation to track twists is customarily realized in the first instance via a corresponding embodiment of a primary suspension. In addition, the property of low warp stiffness of the chassis frame contributes to flexibility and thus to a smoothing-out of track twists.

Derailment safety, on the one hand, and requirements stemming from the calculation of vehicle construction gauges, for example in accordance with Leaflet 505-1 of the Union internationale des chemins de fer (UIC) or the European Standard (EN) 15273, on the other, frequently lead to design conflicts, which will leave a greater proportion of the chassis frame itself smoothing out track twists than is desirable. This can, for example, be realized via a crossmember with low torsional stiffness or via an articulated connection of the crossmember to a first longitudinal carrier and a second longitudinal carrier of the chassis frame.

A crossmember with low torsional stiffness requires a flexible structure with open profiles. In the case of a conventional suspension of a drive motor on a crossmember, such as via consoles, torques are introduced into the structure. For this reason, the crossmember must be formed with torsional stiffness and closed profiles are thus generally employed.

According to the prior art, the Siemens chassis SF7000 is for example known in this connection, in which a drive motor is suspended on a crossmember with closed profiles via consoles and thus has a high torsional stiffness.

Three engineering designs are further known, which enable a crossmember with a low torsional stiffness.

Thus, U.S. Pat. No. 4,046,080 describes the principle of the "Wegmann-chassis", in which a drive motor is suspended at a shear center of a crossmember. Partial support of the drive motor on a transmission is effected via a swash plate. A support guide is located between the drive motor, the transmission and the crossmember.

Mention is also made of a chassis from Construcciones y Auxiliar de Ferrocarriles (CAF), as used in vehicles of the Istanbul Metro's Line M4. Here, the suspension of a drive motor is on a longitudinal carrier. Partial support of the drive motor on a transmission is effected via a swash plate. The transmission is connected to a crossmember via a guide.

WO 2012/123438 Al describes an engineering design, in which a drive motor is supported on a first longitudinal carrier and a second longitudinal carrier of a chassis and rests on a transmission via a swash plate.

The above-cited conventional approaches each have the disadvantage of a joint suspension of a drive motor and a transmission on a chassis frame of a chassis.

Part of the weight force of the drive motor is thereby transferred to the transmission, and unsprung masses of the chassis are consequently increased.

In addition, because of a swash plate arranged between the drive motor and the transmission, separate demountability of the drive motor and of the transmission for maintenance purposes is not provided for the described conventional approaches.

Further, exchanging the drive motor for a model of drive motor with a different interface would require a change to the interfaces between the drive motor and the chassis frame.

SUMMARY OF THE INVENTION

In view of the foregoing, it is an object of the invention to provide a chassis which improves on the conventional chassis.

This and other objects and advantages are achieved in accordance with the invention by a chassis in which at least one first elastic bearing, one second elastic bearing and one third elastic bearing are arranged between the drive motor and the chassis frame, where one of the elastic bearings is in each case arranged on at least one of the longitudinal carriers.

This arrangement of bearing positions between the drive motor and the chassis frame leads to a reduction in the introduction of torques stemming from the drive motor into the chassis frame. It is mainly forces that are introduced. The torque loading of the chassis frame decreases. Open profiles can thereby be used for crossmembers. The warp stiffness of the chassis frame consequently decreases, and alongside the primary suspension, the chassis frame itself contributes to the smoothing-out of track twists. A weight advantage can further be achieved through the use of open profiles.

An advantageous, separate suspension of the drive motor and a transmission further results from the invention. The proportion of the weight force of the drive motor transferred to the transmission is reduced. Unsprung masses of the chassis can thus be reduced which, among other things, cuts the cost of track maintenance. The use of a curved-tooth coupling, which is inexpensive to acquire and maintain, is also thereby enabled. The curved-tooth coupling is furthermore compact in its dimensions, and thus allows maximization of the structural width of the drive motor. In the case of a self-cooled drive motor, the transmission-side front of the motor remains freely accessible for airflow. In addition, the drive motor and the transmission can be demounted separately during maintenance.

Moreover, mechanical decoupling between the drive motor and the chassis frame is achieved via at least the first elastic bearing, the second elastic bearing and the third elastic bearing.

It is favorable if at least one first attachment module, which is connected to the drive motor and to the chassis frame in a releasable manner, is arranged between the drive motor and the chassis frame.

The use of at least the first attachment module has the advantage of more uniform and lower-cost interfaces to the chassis frame and the drive motor. Different drive motors can thus be employed on the chassis frame without changing the interface.

In addition, the use of releasable connections provides the advantage of simple and rapid mountability and demountability of the drive motor and of the at least first attachment module.

In a preferred embodiment, the first attachment module is connected to the transmission in a releasable manner. With this measure, it is achieved that alongside its function of linking the drive motor to the chassis frame, the first attachment module also serves as a torque support of the transmission, and it is thus possible to dispense with additional components. Furthermore, through the arrangement of the first attachment module, different transmissions can be used without interface changes on the chassis frame.

In addition, the use of releasable connections offers the advantage of simple and rapid mountability and demountability of the transmission and of the attachment modules.

An advantageous embodiment is obtained if the crossmember has open profiles.

A low torsional stiffness of the crossmember and thus a partial smoothing-out of track twists is thereby achieved via the chassis frame itself.

In a preferred embodiment, drilled holes provided in the beams of the open profiles for the connection of the drive motor to the chassis frame are arranged such that vertical forces introduced into the open profiles run close to the shear centers of the open profiles.

This measure brings about simple and low-cost interfaces for the arrangement of the drive motor on the chassis frame. A reduction in the torsional loads on the open profiles is further achieved via this measure.

An advantageous embodiment is obtained if at each end of the first longitudinal carrier a first primary spring cup and a second primary spring cup are provided, and the third elastic bearing is arranged between the first primary spring cup and the second primary spring cup. This measure creates a concentration of the application of force on the first longitudinal carrier and on the second longitudinal carrier in the area of the first primary spring cup and of the second primary spring cup, and thus a reduction in the load on the first longitudinal carrier and on the second longitudinal carrier from torques.

It is favorable if the first elastic bearing, the second elastic bearing and the third elastic bearing are arranged such that they form the corner points of a triangle in a horizontal plane, and if the drive motor is arranged such that the horizontal center of gravity of the drive motor is located within the triangle. This measure leads to a homogenization of the load on the first elastic bearing, the second elastic bearing and the third elastic bearing.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention is explained in greater detail below on the basis of exemplary embodiments, in which.

DETAILED DESCRIPTION OF THE EXEMPLARY EMBODIMENTS

Figure 1:
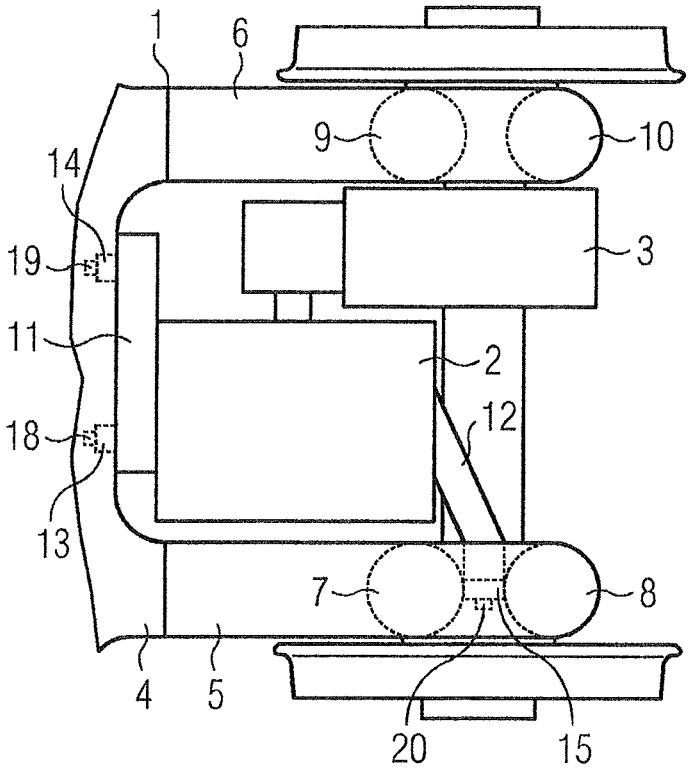
FIG. 1 shows a top view of a side piece of a first, exemplary embodiment of an inventive chassis with inboard wheel sets, a drive motor and a transmission, with a first primary spring cup and a second primary spring cup, where the drive motor is connected to a crossmember via a first attachment module and to a first longitudinal carrier via a second attachment module.

An extract from a first, exemplary embodiment of an inventive chassis shown in top view in FIG. 1, comprises a chassis frame 1, a transversely mounted drive motor 2, a transmission 3, a crossmember 4, a first longitudinal carrier 5, a second longitudinal carrier 6, and a first primary spring cup 7, a second primary spring cup 8, a third primary spring cup 9 and a fourth primary spring cup 10. In an advantageous embodiment, the crossmember 4 is manufactured from open profiles. The first longitudinal carrier 5 and the second longitudinal carrier 6 are, for example, welded to the crossmember 4.

The drive motor 2 is connected to the crossmember 4 via a first attachment module 11, upon which are arranged a first elastic bearing 13 and a second elastic bearing 14.

The drive motor 2 is connected to the first longitudinal carrier 5 via a second attachment module 12 and third elastic bearing 15 arranged thereon. A particularly advantageous three-point suspension thereby results, and no introduction of torques stemming from the drive motor 2 into the chassis frame 1 occurs. Consequently, open profiles can be used for the crossmember 4. The warp stiffness of the chassis frame 1 is hereby reduced, and along with the primary suspension, the chassis frame 1 itself contributes to the smoothing-out of track twists. A weight advantage by comparison with closed profiles can further be achieved through the use of open profiles.

The three-point suspension further leads to a separate mounting of the drive motor 2 and of the transmission 3 in the chassis, by which the proportion of the weight force of the drive motor 2 introduced into the transmission 3 and thus unsprung masses of the chassis decrease.

The advantageous use of the first attachment module 11 and the second attachment module 12 has the result that with the use of uniform interfaces on the chassis frame 1, different drive motors 2, of which exemplary embodiments are represented in FIG. 1, FIG. 2, FIG. 3, FIG. 4, FIG. 7 and FIG. 8, can be employed.

The first elastic bearing 13 and the second elastic bearing 14 are arranged at the ends of the first attachment module 11. The drive motor 2 is connected to the first attachment module 11 in the area between the first elastic bearing 13 and the second elastic bearing 14.

The longitudinal axes of the first elastic bearing 13 and of the second elastic bearing 14 run horizontally and in the longitudinal direction of the chassis.

Figure 6:
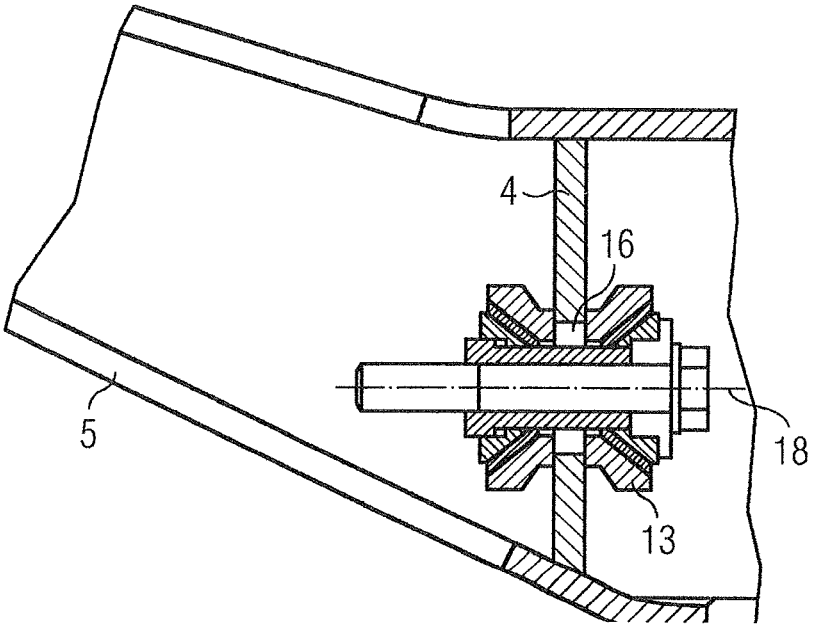
FIG. 6 shows a detailed representation of a sectional view through a crossmember, where a first elastic bearing is arranged in a beam of an open profile of the crossmember.

The first elastic bearing 13 and the second elastic bearing 14 are inserted in drilled holes arranged on the crossmember 4. An exemplary embodiment of a first drilled hole 16 is shown in FIG. 6.

The first elastic bearing 13 and the second elastic bearing 14 are braced to the first attachment module 11 and the crossmember 4 via a first screw connection 18 and a second screw connection 19, whose longitudinal axes extend coaxially with the longitudinal axes of the first elastic bearing 13 and the second elastic bearing 14. They are, for example, formed as rubber-metal elements of known structural form, and enable a relative movement between the first attachment module 11 and the crossmember 4 in a horizontal and in a vertical direction.

In an advantageous embodiment, all connections between the first attachment module 11, the drive motor 2, the first elastic bearing 13 and the second elastic bearing 14 are force-fitted and releasable, by which rapid mountability and demountability of the drive motor 2 and of the first attachment modules 11 result.

The second attachment module 12 is arranged between the drive motor 2 and the first longitudinal carrier 5, where one end of the second attachment modules 12 is connected to the first longitudinal carrier 5 and the other end of the second attachment modules 12 is connected to the drive motor 2.

In an exemplary manner, the third elastic bearing 15 is formed as an elastic sleeve of known structural form, is arranged between the second attachment module 12 and the first longitudinal carrier 5, and enables a relative movement between the second attachment module 12 and the first longitudinal carrier 5 in a horizontal and vertical direction. The longitudinal axis of the third elastic bearings 15 extends horizontally and in the transverse direction of the chassis.

Figure 5:
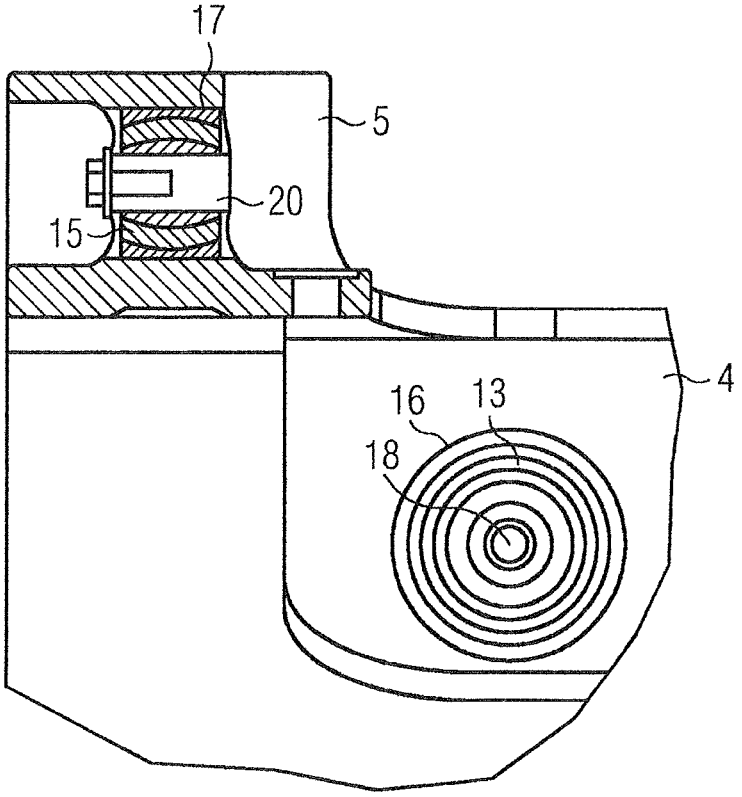
FIG. 5 shows a detailed representation of a sectional view through a first longitudinal carrier, where a third elastic bearing is shown at the bottom right arranged in a beam of the first longitudinal carrier, and a first elastic bearing is shown at the top left arranged in a crossmember.

The third elastic bearing 15 is inserted into a second drilled hole 17 arranged on the first longitudinal carrier 5, and braced with the first longitudinal carrier 5 via a first pin 20. The longitudinal axis of the first pins 20 extends coaxially to the longitudinal axis of the third elastic bearing 15. An exemplary embodiment of the second drilled hole 17 is shown in FIG. 5.

The second drilled hole 17 for accommodation of the third elastic bearing 15 is arranged between the first primary spring cup 7 and the second primary spring cup 8. As a result of this characteristic, the torque load on the first longitudinal carrier 5 decreases.

All connections between the second attachment module 12, the drive motor 2 and the third elastic bearing 15 are force-fitted and releasable, by which rapid mountability and demountability of the drive motor 2 and of the second attachment modules 12 result.

Figure 2:
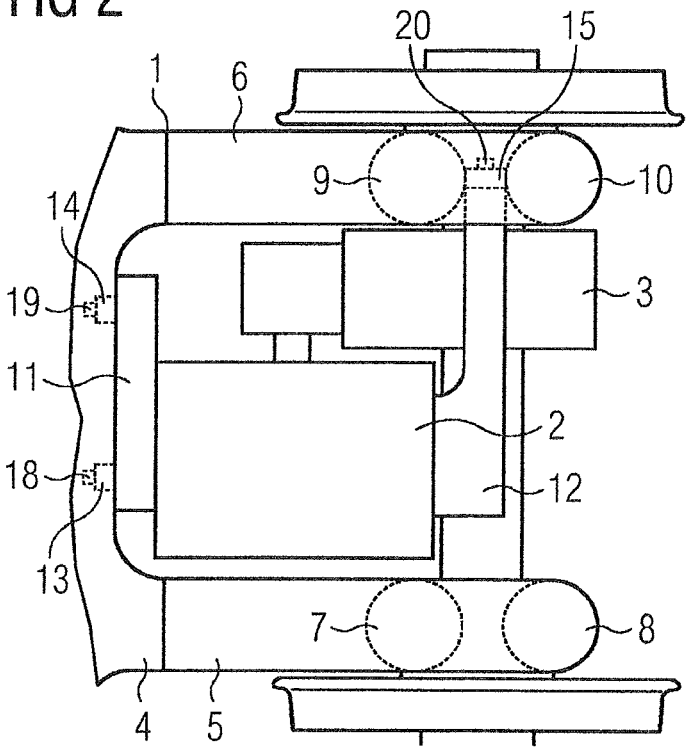
FIG. 2 shows a top view of a side piece of a second, exemplary embodiment of an inventive chassis with inboard wheel sets, a drive motor and a transmission, with a first primary spring cup and a second primary spring cup, where the drive motor is connected to a crossmember via a first attachment module and to a second longitudinal carrier via a second attachment module.

In contrast to FIG. 1, FIG. 2 shows a second, exemplary embodiment, in which a second attachment module 12 is connected to a drive motor 2 and via a third elastic bearing 15 to a second longitudinal carrier 6. Otherwise, the principle shown in FIG. 2 corresponds to the embodiment represented in FIG. 1.

Figure 3:
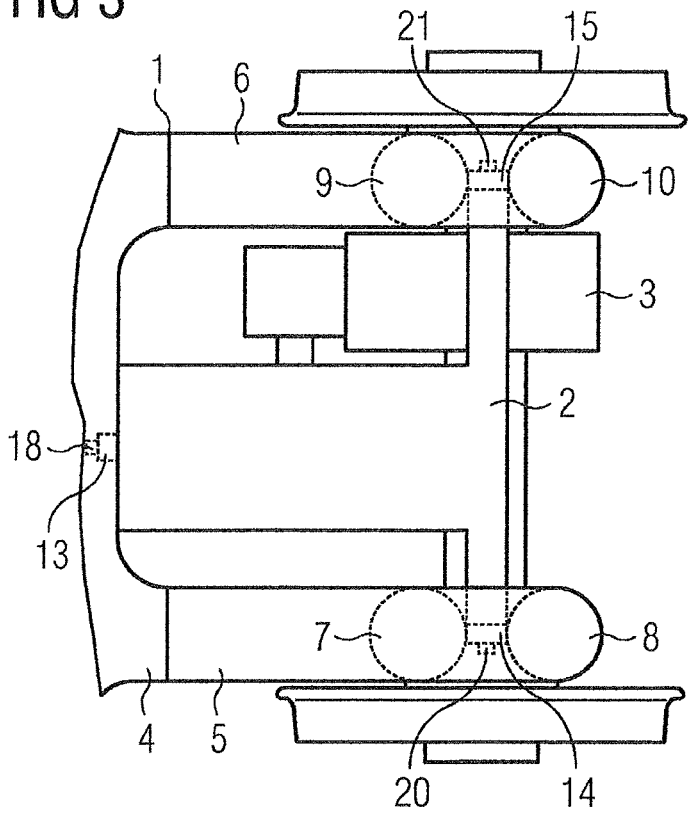
FIG. 3 shows a top view on a third, exemplary embodiment of an inventive chassis, where a drive motor is connected to a first longitudinal carrier, a second longitudinal carrier and a crossmember.

FIG. 3 shows the top view of a third, exemplary embodiment of an inventive chassis with a chassis frame 1, in which a first elastic bearing 13 is arranged between a drive motor 2 and a crossmember 4, a second elastic bearing 14 is arranged between the drive motor 2 and a first longitudinal carrier 5 and a third elastic bearing 15 is arranged between the drive motor 2 and a second longitudinal carrier 6. The longitudinal axis of the first elastic bearings 13 extends horizontally and in the longitudinal direction of the chassis. The longitudinal axes of the second elastic bearing 14 and of the third elastic bearing 15 extend horizontally and in the transverse direction of the chassis. The first elastic bearing 13 is, for example, formed as a rubber-metal element, and braced with the crossmember 4 via a first screw connection 18. The second elastic bearing 14 and the third elastic bearing 15 are, for example, formed as elastic sleeves.

The second elastic bearing 14 is connected to the first longitudinal carrier 5 between a first primary spring cup 7 and a second primary spring cup 8 via a first pin 20. The third elastic bearing 15 is arranged on the second longitudinal carrier 6 between a third primary spring cup 9 and a fourth primary spring cup 10 via a second pin 21.

In this embodiment, a first attachment module 11 and a second attachment module 12, as shown in FIG. 1 and FIG. 2, are dispensed with. The drive motor 2 is connected directly to the chassis frame 1 via the first elastic bearing 13, the second elastic bearing 14 and the third elastic bearing 15.

Otherwise, the principle shown in FIG. 3 corresponds to the embodiments represented in FIG. 1 and FIG. 2.

Figure 4:
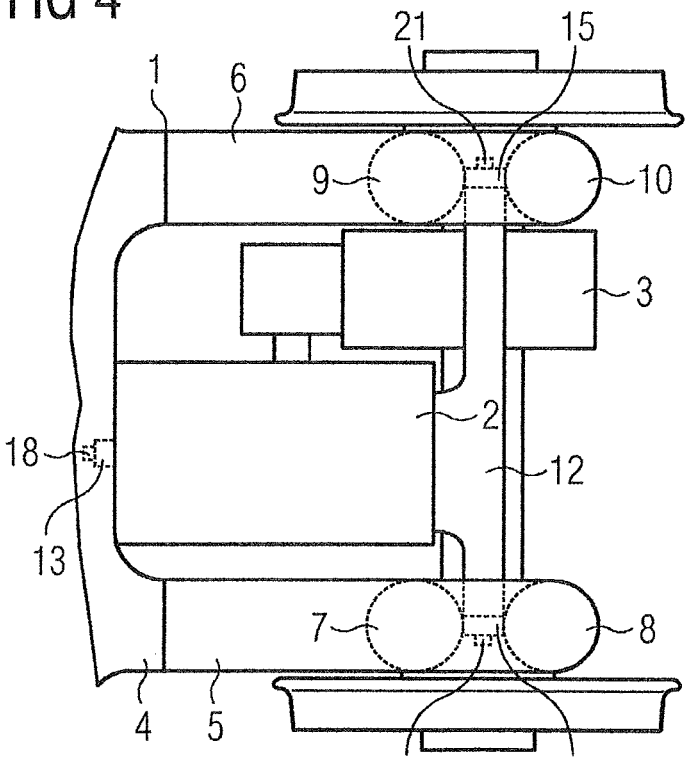
FIG. 4 shows a top view of a fourth, exemplary embodiment of an inventive chassis, where a drive motor is connected to a first longitudinal carrier, a second longitudinal carrier and a crossmember, and an attachment module is arranged between the drive motor and the first longitudinal carrier and the second longitudinal carrier.

FIG. 4 shows the top view of a fourth, exemplary embodiment of an inventive chassis with a chassis frame 1, in which a first elastic bearing 13 is arranged between a drive motor 2 and a crossmember 4, a second elastic bearing 14 is arranged between the drive motor 2 and a first longitudinal carrier 5 and a third elastic bearing 15 is arranged between the drive motor 2 and a second longitudinal carrier 6.

In contrast to the embodiment shown in FIG. 3, a second attachment module 12 is provided between the drive motor 2, the second elastic bearing 14 and the third elastic bearing 15. The second elastic bearing 14 and the third elastic bearing 15 are arranged at the ends of the second attachment module 12. The drive motor 2 is connected to the second attachment module 12 between the second elastic bearing 14 and the third elastic bearing 15.

Otherwise, the principle shown in FIG. 4 corresponds to the embodiments represented in FIG. 1, FIG. 2 and FIG. 3.

FIG. 5 shows a detailed representation of a sectional view through a first longitudinal carrier 5. A portion of crossmember 4 is additionally shown.

A third elastic bearing 15 with a first pin 20 is inserted into a second drilled hole 17 arranged in a beam of the first longitudinal carrier 5.

The crossmember 4 has a first drilled hole 16, in which is arranged a first elastic bearing 13 with a first screw connection 18.

FIG. 6 shows a detailed representation of a section through a crossmember 4. A portion of a first longitudinal carrier 5 is additionally shown.

In a beam of an open profile of the crossmember 4, a first elastic bearing 13 with a first screw connection 18 is arranged in a first drilled hole 16.

Figure 7:
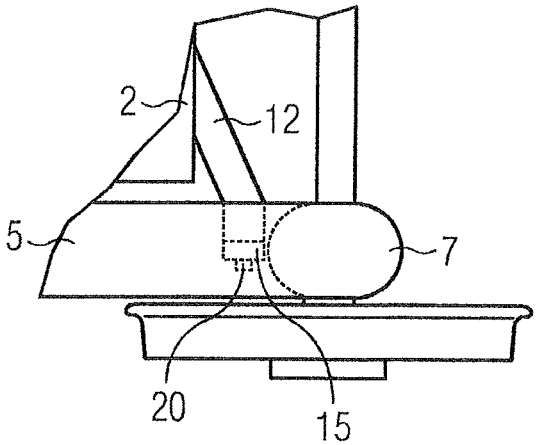
FIG. 7 shows a detailed representation of a top view of a side piece of a fifth, exemplary embodiment of an inventive chassis with inboard wheel sets, a drive motor and a transmission, with a first primary spring cup, where the drive motor is connected to a crossmember via a first attachment module and to a first longitudinal carrier via a second attachment module.

FIG. 7 shows a detailed representation of a top view of a fifth, exemplary embodiment of an inventive chassis. A drive motor 2 is connected via a second attachment module 12 and a third elastic bearing 15 to a first longitudinal carrier 5, comprising at its end a first primary spring cup 7. The third elastic bearing 15 is arranged approximately adjacent to the first primary spring cup 7. A reduction in the torque load on the first longitudinal carrier 5 is thereby achieved.

With the exception of the embodiment of the primary suspension, the principle shown in FIG. 7 corresponds to the embodiment represented in FIG. 1.

Figure 8:
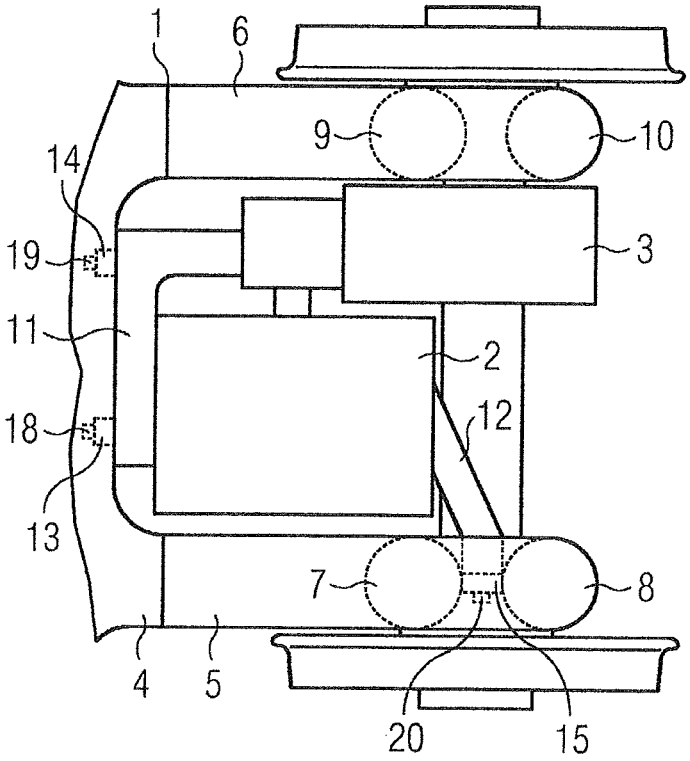
FIG. 8 shows a top view of a side piece of a sixth, exemplary embodiment of an inventive chassis with inboard wheel sets, a drive motor and a transmission, with a first primary spring cup and a second primary spring cup, where a first attachment module connects the drive motor to a crossmember and the transmission and a second attachment module connects the drive motor to a first longitudinal carrier.

In contrast to FIG. 1, FIG. 8 shows a sixth, exemplary embodiment of an inventive chassis, in which a first attachment module 11, in addition to a connection to a drive motor 2, also has a connection to a transmission 3.

The advantage thereby results that the first attachment module 11, alongside its function of linking the drive motor 2 to a chassis frame 1, also functions as a torque support of the transmission 3, and it is thus possible to dispense with additional components.

Otherwise, the principle shown in FIG. 8 corresponds to the embodiment represented in FIG. 1.

The invention claimed is:

1. A chassis for a rail vehicle including inboard wheel sets, comprising:

at least one transmission;

at least one transversely mounted drive motor;

at least one chassis frame comprising at least one crossmember, at least one first longitudinal carrier and a second longitudinal carrier;

at least one first elastic bearing;

a second elastic bearing;

a third elastic bearing, the at least one first elastic bearing, the second elastic bearing and the third elastic bearing each being arranged between the drive motor and the chassis frame; and a first primary spring cup and a second primary spring cup arranged at each end of the at least one first longitudinal carrier;

wherein the third elastic bearing is arranged between the first primary spring cup and the second primary spring cup; and wherein one elastic bearing of the first and second elastic bearings is arranged on at least one longitudinal carrier of the first and second longitudinal carriers.

2. The chassis as claimed in claim 1, wherein the at least one first elastic bearing and the second elastic bearing are arranged between the drive motor and the crossmember and the third elastic bearing is arranged between the drive motor and the at least one first longitudinal carrier.

3. The chassis as claimed in claim 2, wherein the crossmember has open profiles.

4. The chassis as claimed in claim 2, wherein drilled holes provided in the beams of the open profiles for the connection of the drive motor to the chassis frame are arranged such that vertical forces introduced into the open profiles extend proximal to the shear centers of the open profiles.

5. The chassis as claimed in claim 1, further comprising:

a respective first primary spring cup arranged at each respective end of the at least one first longitudinal carrier;

wherein the third elastic bearing is arranged approximately adjacent to the respective first primary spring cup.

6. The chassis as claimed in claim 1, wherein the at least one first elastic bearing and the second elastic bearing are arranged between the drive motor and the crossmember and the third elastic bearing is arranged between the drive motor and the second longitudinal carrier.

7. The chassis as claimed in claim 6, wherein the crossmember has open profiles.

8. The chassis as claimed in claim 6, wherein drilled holes provided in the beams of the open profiles for the connection of the drive motor to the chassis frame are arranged such that vertical forces introduced into the open profiles extend proximal to the shear centers of the open profiles.

9. The chassis as claimed in claim 6, further comprising:

a third primary spring cup and a fourth primary spring cup arranged at each end of the second longitudinal carrier;

wherein the third elastic bearing is arranged between the third primary spring cup and the fourth primary spring cup.

10. The chassis as claimed in claim 6, further comprising:

a respective third primary spring cup arranged at each respective end of the second longitudinal carrier;

wherein the third elastic bearing is arranged approximately adjacent to the respective third primary spring cup.

11. The chassis as claimed in claim 1, wherein the at least one first elastic bearing is arranged between the drive motor and the crossmember, the second elastic bearing is arranged between the drive motor and the at least one first longitudinal carrier and the third elastic bearing is arranged between the drive motor and the second longitudinal carrier.

12. The chassis as claimed in claim 11, wherein the crossmember has open profiles.

13. The chassis as claimed in claim 11, wherein drilled holes provided in the beams of the open profiles for the connection of the drive motor to the chassis frame are arranged such that vertical forces introduced into the open profiles extend proximal to the shear centers of the open profiles.

14. The chassis as claimed in 11, further comprising:

a respective first primary spring cup arranged at each respective end of the at least one first longitudinal carrier; and a respective third primary spring cup arranged at each respective end of the second longitudinal carrier;

wherein the second elastic bearing is arranged approximately adjacent to the respective first primary spring cup; and wherein the third elastic bearing is arranged approximately adjacent to the respective third primary spring cup.

15. The chassis as claimed in claim 1, wherein the first attachment module is connected to the transmission in a releasable manner.

16. The chassis as claimed in claim 1, wherein the crossmember has open profiles.

17. The chassis as claimed in claim 16, wherein drilled holes provided in the beams of the open profiles for the connection of the drive motor to the chassis frame are arranged such that vertical forces introduced into the open profiles extend proximal to the shear centers of the open profiles.

18. The chassis as claimed in claim 1, wherein drilled holes provided in the beams of the open profiles for the connection of the drive motor to the chassis frame are arranged such that vertical forces introduced into the open profiles extend proximal to the shear centers of the open profiles.

19. The chassis as claimed in claim 1, further comprising:

a third primary spring cup and a fourth primary spring cup arranged at each end of the second longitudinal carrier;

wherein the third elastic bearing is arranged between the third primary spring cup and the fourth primary spring cup.

20. The chassis as claimed in claim 1, further comprising:

a respective first primary spring cup arranged at each respective end of the at least one first longitudinal carrier;

wherein the third elastic bearing is arranged approximately adjacent to the respective first primary spring cup.

21. The chassis as claimed in claim 1, further comprising:

a respective third primary spring cup arranged at each respective end of the second longitudinal carrier;

wherein the third elastic bearing is arranged approximately adjacent to the respective third primary spring cup.

22. The chassis as claimed in 1, further comprising:

a respective first primary spring cup arranged at each respective end of the at least one first longitudinal carrier; and a respective third primary spring cup arranged at each respective end of the second longitudinal carrier;

wherein the second elastic bearing is arranged approximately adjacent to the respective first primary spring cup; and wherein the third elastic bearing is arranged approximately adjacent to the respective third primary spring cup.

23. The chassis as claimed in claim 1, wherein the first elastic bearing, the second elastic bearing and the third elastic bearing are arranged to form corner points of a triangle in a horizontal plane, and wherein the drive motor is arranged such that a horizontal center of gravity of the drive motor is located within the triangle.

* * * * *